US005947170A

United States Patent [19]

Poynter et al.

[11] Patent Number: 5,947,170

[45] Date of Patent: Sep. 7, 1999

[54] ASEPTIC LIQUID FILLING

[75] Inventors: Richard Q. Poynter; Jeffrey L. Price, both of Palm Beach Gardens; Michael J. Schoenewolff, West Palm Beach; Michael C. Derby, Lake Worth, all of Fla.

[73] Assignee: Vital Signs Inc., Totowa, N.J.

[21] Appl. No.: 09/021,473

[22] Filed: Feb. 10, 1998

[51] Int. Cl.[6] ..... B65B 1/04

[52] U.S. Cl. ..... 141/93; 141/85; 454/188; 222/630

[58] Field of Search ..... 141/85, 89–93; 454/187, 188; 222/603; 239/545

[56] References Cited

U.S. PATENT DOCUMENTS

| | | | |
|---|---|---|---|
| 3,728,866 | 4/1973 | Layton | 62/16 |
| 3,760,446 | 9/1973 | Payton | 454/188 |
| 4,409,889 | 10/1983 | Burleson | 98/33 A |
| 4,530,272 | 7/1985 | Stokes | 98/34.5 |
| 4,587,793 | 5/1986 | Brennan et al. | 53/425 |
| 4,609,103 | 9/1986 | Bimer et al. | 206/328 |
| 4,660,464 | 4/1987 | Tanaka | 98/115.3 |
| 4,699,296 | 10/1987 | Schrock, Jr. | 222/85 |
| 4,699,640 | 10/1987 | Suzuki et al. | 55/385 A |
| 4,765,810 | 8/1988 | Wetzel | 55/270 |
| 4,876,746 | 10/1989 | Howie | 2/69 |
| 4,880,581 | 11/1989 | Dastoli et al. | 11/89 |
| 5,014,608 | 5/1991 | Benson et al. | 5/91 |
| 5,366,409 | 11/1994 | Riley | 454/188 |
| 5,401,212 | 3/1995 | Marvell et al. | 454/187 |
| 5,417,610 | 5/1995 | Spransy | 454/187 |
| 5,534,222 | 7/1996 | Kelbrick et al. | 422/33 |
| 5,626,820 | 5/1997 | Kinkead et al. | 422/122 |

FOREIGN PATENT DOCUMENTS

| | | | |
|---|---|---|---|
| 0151735 | 12/1984 | European Pat. Off. | F24F 11/04 |
| 0291783 | 5/1988 | European Pat. Off. | B01D 46/00 |

*Primary Examiner*—Steven O. Douglas
*Attorney, Agent, or Firm*—R. Gale Rhodes, Jr.

[57] ABSTRACT

Process and apparatus for providing a HEPA air shower to the critical fill zone of the liquid filling operation for preventing entry of particulate, non-viable and viable particulate, into the critical filling zone by providing opposed flows of pressurized HEPA air to the critical filling zone to provide the HEPA air shower.

10 Claims, 2 Drawing Sheets

FIG. 2
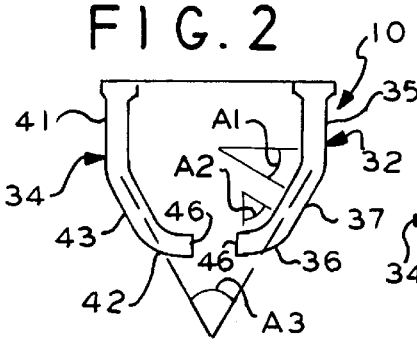
FIG. 3
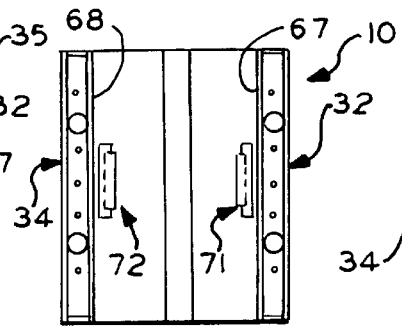
FIG. 4
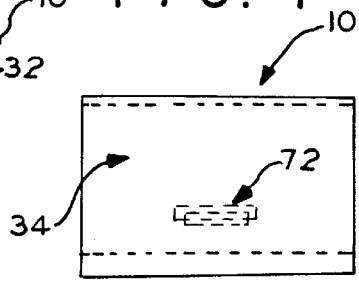
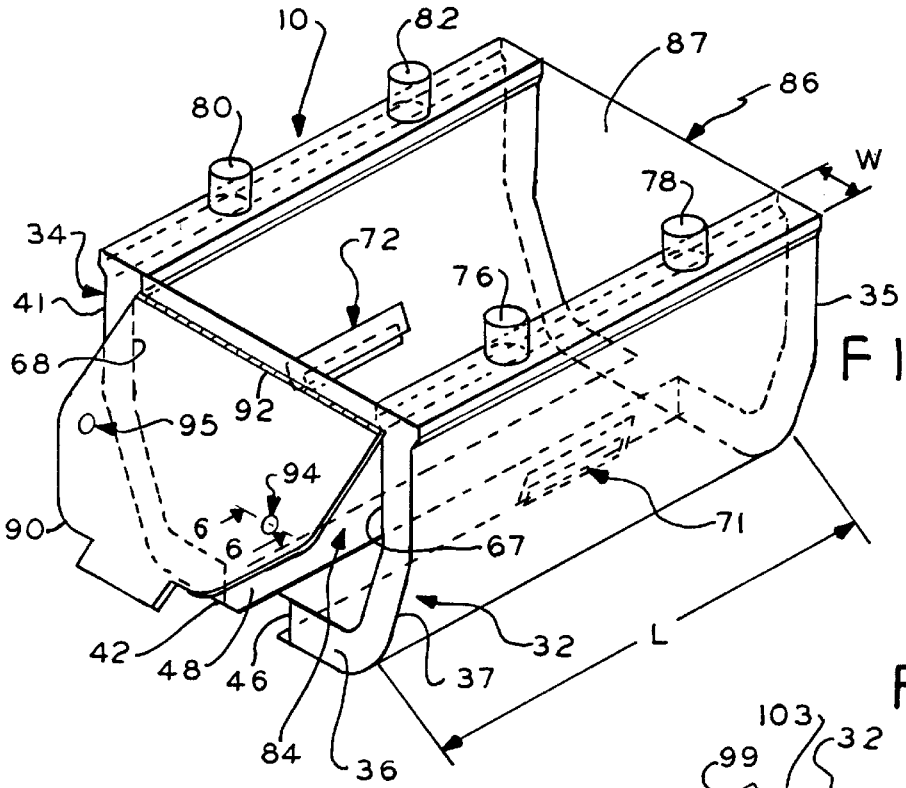
FIG. 5
FIG. 6
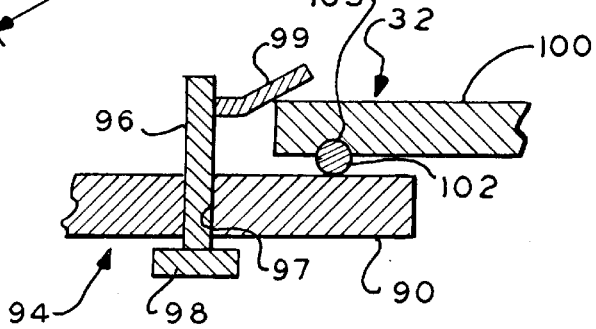

ASEPTIC LIQUID FILLING

BACKGROUND OF THE INVENTION

This invention relates generally to aseptic liquid filling and more particularly relates to process and apparatus for providing a HEPA air shower to the critical fill or filling zone of a liquid filling operation, such as for example a blow-fill-sealing operation, to prevent entry of particulate, non-viable and viable particulate, into the critical filling zone.

Numerous patents disclose methods and apparatus for forming, such as by blow molding, filling such as with a liquid, and sealing a container containing the liquid. Note for example, U.S. Pat. Nos. 3,251,915; 3,464,085; 3,523,401; 3,597,793; 3,664,793; 3,674,405; 3,719,374; 4,176,153; 4,178,976; 4,997,014 and Re. 27,155; and patents cited therein.

As generally known to those skilled in the art, the blow-fill-sealing process is an automated process by which plastic containers are formed, filled with liquid, and sealed in one continuous operation. More particularly, and as further known to those skilled in the art, in the blow-fill-sealing process a hollow, cylindrical plastic parison is extruded downwardly between cavities provided in pairs of open and opposed main and sealing molds mounted for reciprocal movement toward and away from each other; the mold cavities are shaped complementarily to the plastic container to be formed. The main molds are then closed around the plastic parison to seal the bottom of the container after which pressurized air, in the blow molding step, is forced into the plastic parison to force the plastic parison outwardly against the walls of the main mold cavities to partially form the container but leaving the container top open for subsequent liquid filling. Thereafter, a liquid fill nozzle is advanced above, or slightly into, the open top of the partially formed plastic container and liquid, such as a sterile liquid, e.g., a pharmaceutical solution, is injected or dispensed into the partially formed plastic container after which the nozzle is withdrawn and the seal molds are closed to seal the upper portion of the container and complete a pre-liquid filled plastic container.

Aside from the economic advantages of the blow-fill-sealing process, such process is a favored process for aseptic filling of sterile liquid products, such as the above-noted pharmaceutical solution, due to the limited need for human intervention in the process, and hence minimal opportunity for microbial or pathogenic microorganism contamination due to human intervention. One limitation, as is also known to those skilled in the art, is that in the blow-fill-sealing process non-viable particulate, or particulate matter or particles, are generated during the extrusion of the plastic parison in the container blow-fill-sealing process noted above. These non-viable particulate can potentially provide the means of transport for viable microorganisms, particularly pathogenic microorganisms, into the partially formed and open plastic container prior to the sealing step. As is still further known to those skilled in the art, in an effort to protect the pre-liquid fill product produced by the blow-fill-sealing process, blow-fill-sealing apparatus or machine have been provided with shrouds at the critical fill or filling zone. The critical filling zone, as known to the art and as used hereinafter and in the appended claims, means the zone immediately surrounding or encompassing the open top of the partially formed plastic container and at least a portion of the liquid fill nozzle, such critical filling zone is shown by the dashed circle in FIG. 1 bearing numerical designation 30; such critical filling zone is sometimes referred to in the art as the fill/nozzle area.

A prior art shroud known to the art for preventing entry of the particulate into the critical filling zone includes a single duct for receiving and communicating a single flow of pressurized high efficiency particulate air (HEPA air) from a single direction to the critical filling zone to prevent entry of particulate to the critical fill zone; such flow of pressurized HEPA air to the critical filling zone is referred to in the art and hereinafter and in the appended claims as a HEPA air shower.

However, there exists a need in the art for improved process and apparatus for more effectively preventing entry of particulate, non-viable and viable particulate, into the critical filling zone to further enhance aseptic liquid filling of products, such as for example, pre-liquid filled plastic containers produced by the above-noted blow-fill-sealing operation.

SUMMARY OF THE INVENTION

It is the object of the present invention to satisfy the foregoing need in the art.

Process and apparatus satisfying such need and embodying the present invention include process and apparatus for providing a HEPA air shower to the critical fill zone of the liquid filling operation for preventing entry of particulate, non-viable and viable particulate, into the critical filling zone of a liquid filling operation by providing opposed flows of pressurized HEPA air into the critical filling zone to provide the HEPA air shower.

DESCRIPTION OF THE DRAWINGS

FIG. 2 is an outline front elevational view of the shroud of FIG. 1;

FIG. 3 is a top view of the shroud shown in FIG. 2;

FIG. 4 is a left side view of the shroud shown in FIG. 2;

FIG. 5 is a perspective view of the shroud shown in FIGS. 1–4; and

FIG. 6 is a cross-sectional view of a fastener of the present invention for fastening the pivotally mounted door to the shroud; the view is taken generally downwardly along the line 6—6 in FIG. 1 but shown in FIG. 6 with the door fastened to the shroud.

DESCRIPTION OF THE PREFERRED EMBODIMENT

Figure 1:
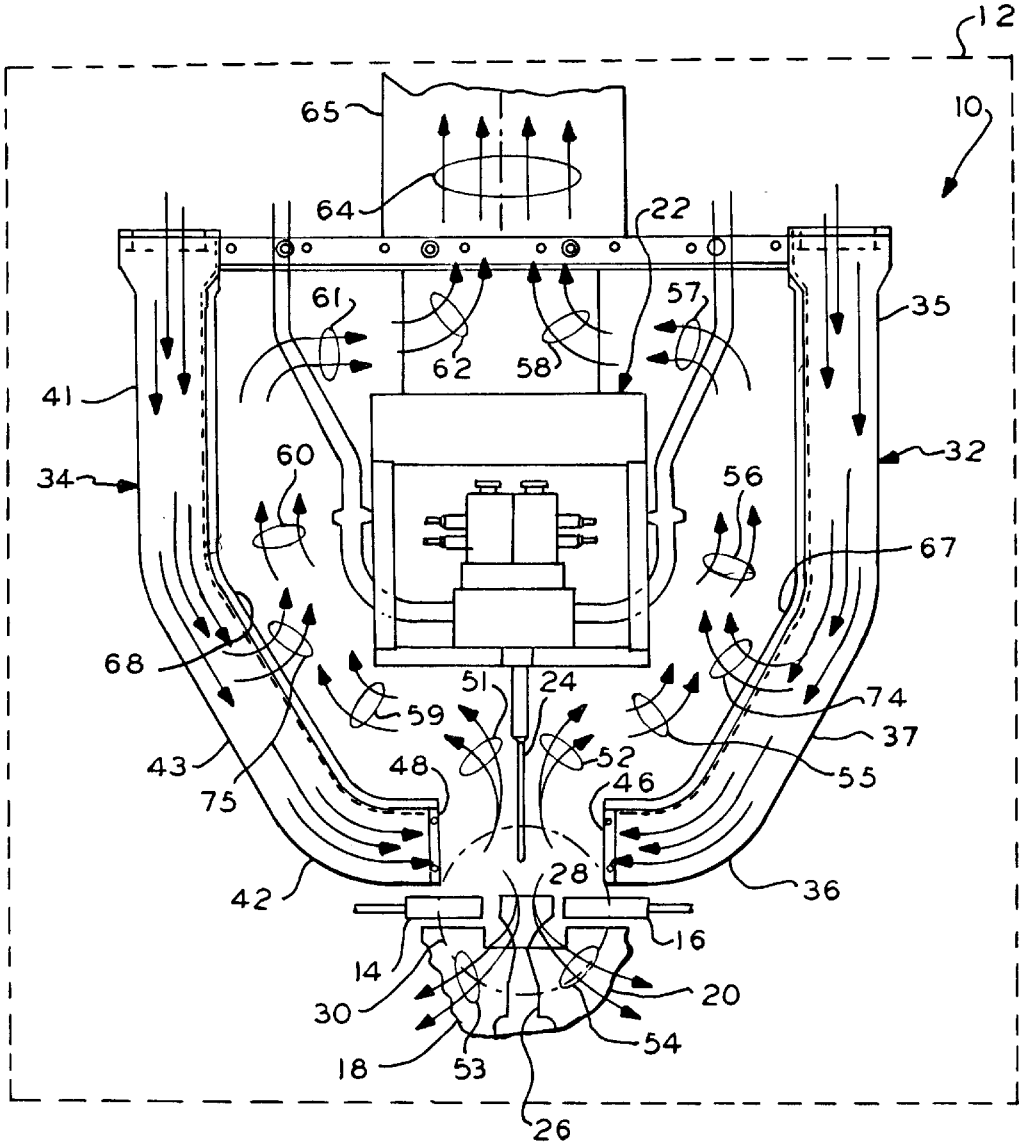
FIG. 1 is a front end elevational view of a shroud embodying the present apparatus invention and particularly useful for practicing the process of the present invention, the blow-fill-seal apparatus or machine on which the shroud of the present invention is mounted is indicated by the surrounding dashed rectangular outline and which machine includes seal molds and main molds partially shown in solid outline.

Referring to the drawings, and in particular to FIG. 1, a generally U-shaped shroud embodying the present invention is shown and indicated by general numerical designation 10. In FIG. 1, the shroud 10 is mounted suitably to blow-fill-seal apparatus or machine indicated diagrammatically by the dashed rectangular outline 12 surrounding the shroud 10 and which blow-fill-seal machine may be any suitable blow-fill-seal machine known to the art such as, for example, a blow-fill-seal machine available from Automatic Liquid Packaging, Inc. of Woodstock, Ill. and from Vital Pharma, Inc. of Riviera Beach, Fla. As known to the art, the blow-fill-seal machine 12 includes a pair of partially shown opposed and reciprocally mounted seal molds 14 and 16 and a pair of partially shown opposed and reciprocally mounted main molds 18 and 20. The blow-fill-seal machine or apparatus 12 further includes, as known to the art, liquid filling apparatus or system indicated by general numerical designation 22 which includes a liquid filling nozzle 24. A partially formed plastic container, partially formed by the above-noted blow-molding step, is shown in FIG. 1 and indicated by numerical designation 26. The partially formed plastic container 26 includes an open upper portion or top having an opening indicated by numerical designation 28. The critical fill or filling zone as noted above is indicated by the dashed circle 30 in FIG. 1. It will be further understood from FIG. 1 that the shroud 10 is mounted suitably to the blow-fill-seal machine 12 to at least partially enclose or surround the liquid filling system 22.

Referring further to the drawings, and in particular to FIGS. 1, 2 and 5, the shroud 10 includes a pair of opposed, hollow ducts indicated by general numerical designations 32 and 34. Duct 32, particularly FIG. 2, includes a linearly extending vertical upper portion 35, a linearly extending horizontal lower portion 36, and a linearly extending angular intermediate portion 37 intermediate and interconnecting the upper and lower duct portions 35 and 36. Duct 34 includes a linearly extending vertical upper portion 41, a linearly extending horizontal lower portion 42, and a linearly extending angular intermediate portion 43 intermediate and interconnecting the upper and lower portions 41 and 42. It will be particularly understood with regard to representative duct 32, and FIG. 2, that the intermediate angular portion 37 of duct 35 is disposed angularly with respect to both the upper portion 35 and the lower portion 36 and forms a first included angle A1 with respect to the upper vertical portion 35 and a second included angle A2 with respect to the lower horizontal portion 36; the angular portion 43 of duct 34 is similarly angularly disposed with respect to duct portions 41 and 42. In the preferred embodiment, the first included angle A1 is about 150° and the second included angle A2 is about 120°. As will be further noted from FIG. 2, the angularly disposed intermediate portions 37 and 43 of the respective ducts 32 and 34 are disposed angularly with respect to each other at a third included angle A3 which in the preferred embodiment is about 60°.

As will be understood particularly from FIGS. 2 and 5, the lower portions 36 and 42 of the respective ducts 32 and 34 have opposed and spaced apart openings 46 and 48. As will be understood from FIG. 1, the ducts 32 and 34 are for receiving and communicating opposed flows of pressurized HEPA air, indicated by the arrows inside the ducts, through the opposed and spaced apart openings 46 and 48 to the critical filling zone 30 to provide a HEPA air shower indicated by the groups of arrows 51, 52, 53 and 54. The HEPA air shower provides a positive pressure region in the critical filling zone 30 which is positive with respect to the pressure of the air surrounding the critical filing zone 30 and which positive pressure region prevents the entry of non-viable and viable particulate into the critical filling zone. The groups of arrows 55, 56, 57 and 58 and groups of arrows 59, 60, 61 and 62, and arrows 64, indicate the exiting of the HEPA air and removal of particulate upwardly from the shroud 10 and through a suitable chimney 65 mounted above the shroud and to the blow-fill-seal machine 12. The HEPA air introduced into the ducts 32 and 34 is provided by a suitable HEPA air blower of the type known to the art and which HEPA air typically passes through a laminar flow grade 99.99% efficient filter. The velocity of such HEPA air typically is between 300–600 fpm.

As will be particularly noted from FIGS. 1, 3 and 5, the ducts 32 an 34 include, respectively, generally opposed inner walls 67 and 68 provided, respectively, with adjustable vents indicated by general numerical designations 71 and 72 for communicating variable portions of the pressurized HEPA air in the ducts to the interior of the shroud 10, as indicated by the pairs of arrows 74 and 75 shown in FIG. 1 to assist in carrying away the particulate. The adjustable vents 71 and 72 may be of the type known to the art including a slidable member mounted for reciprocal sliding movement to partially open, partially close, or fully shut or fully open, an associated opening or aperture.

As will be understood from FIG. 5 and representative duct 32, the ducts have a length L and a width W with the length L being greater than the width W. As will be further noted from FIG. 5, the upper portions of the respective ducts 32 and 34 are flared outwardly and the tops of the ducts are closed except for the openings 76 and 78 formed in the top of duct 35 and the openings 80 and 82 formed in the top of the duct 34; the openings are for admitting the pressurized HEPA air into the ducts.

As will be understood particularly from the perspective view of FIG. 5, the shroud 10 has an open forward end indicated by general numerical designation 84 and a closed rearward end indicated by general numerical designation 86 with the rearward end 86 being closed by a generally planar closure member 87 mounted suitably to the rearward portions of the ducts 32 and 34. The shroud 10 further includes a door 90 mounted pivotally or hingedly to the top portion of the shroud forward end 84 by a suitable hinge 92. The door 90 is complementary in shape to the shroud forward end 84 and in the preferred embodiment is made of a suitable transparent plastic to permit viewing, for example, of the liquid filling apparatus 22 shown in FIG. 1. The door 90 may be provided with a pair of fasteners indicated by general numerical designations 94 and 95 in FIG. 5.

As will be understood by reference to FIG. 6 and representative fastener 94, the fastener 94 includes a shaft 96 mounted rotatably in an opening 97 formed in the door 90, a manually rotatable knob 98 mounted fixedly to the shaft 96 for rotation therewith and an angular camming member 99 mounted fixedly to the shaft 96 for rotation therewith. The duct 32 may include a flange portion 100 as shown in FIG. 6. A gasket 102 may be provided in a groove 103 formed in the flange portion 100. Upon closure of the door 90, and upon manual rotation of the knob 98, the shaft 96 rotates the angular camming member 99 which forces the door toward the duct flange portion 100 compressing the gasket 102 placing the door in air tight engagement with the shroud 10.

Lastly, and referring again to FIGS. 1, 2 and 5, it will be understood that the upper vertical portions 35 and 41 of the respective ducts 32 and 34 are substantially parallel and that the lower horizontal portions 36 and 42 of the respective ducts 32 and 34 reside substantially in the same horizontal plane.

It will be understood that many variations and modifications may be made in the present invention without departing from the spirit and the scope thereof.

What is claimed is:

1. Apparatus for providing a HEPA air shower to the critical filling zone of a liquid filling operation to provide a positive pressure region in the critical filling zone which is positive with respect to the pressure of the air surrounding the critical filing zone to prevent entry of particulate into the critical filling zone, comprising:

a shroud including a pair of generally opposed ducts, each duct including a linearly extending vertical upper portion, a linearly extending horizontal lower portion, and a linearly extending intermediate portion intermediate said upper portion and said lower portion, said intermediate portion disposed angularly with respect to said upper portion and said lower portion and forming a first included angle with respect to said upper portion and a second included angle with respect to said lower portion, said lower portions having opposed and spaced apart openings, and said ducts for receiving and communicating opposed flows of pressurized HEPA air through said opposed and spaced apart openings to the critical filling zone to provide the positive pressure region to the critical filling zone.

2. The apparatus according to claim 1 wherein said ducts have generally opposed inner walls provided with generally opposed adjustable vents for communicating variable portions of the pressurized HEPA air to the interior of said shroud to at least assist in carrying away particulate from the critical filling zone.

3. The apparatus according to claim 2 wherein said upper portions have outwardly flared upper portions and closed tops provided with a plurality of openings for admitting the pressurized HEPA air into said ducts.

4. The apparatus according to claim 1 wherein said ducts have a length and a width and wherein the length of said ducts is greater than said width.

5. The apparatus according to claim 1 wherein said first included angle is about 150° and wherein said second included angle is about 120° and wherein said intermediate portions of said ducts are disposed angularly with respect to each other at a third included angle of about 60°.

6. The apparatus according to claim 1 wherein said shroud has a forward end and a rearward end and wherein said shroud further includes a general planar closure member closing the rearward end of said shroud.

7. The apparatus according to claim 6 wherein said apparatus further comprises a door mounted pivotally to said forward end of said shroud and fastening means for fastening said door to said forward end of said shroud.

8. The apparatus according to claim 7 wherein one of said door and said forward end of said shroud is provided with a gasket for being compressed upon said door being fastened to said forward end of said shroud by said fastening means to provide an air tight seal between said door and said shroud.

9. The apparatus according to claim 7 wherein said fastening means includes a pair of fasteners, each fastener including a shaft mounted rotatably in said door, said shaft including an inner end and an outer end, a knob mounted to said outer end of said shaft and a camming member mounted to said inner end of said shaft, upon closure of said door to said shroud and upon manual rotation of said knob, said camming member for engaging a portion of said shroud to force said door into engagement with said shroud to compress said gasket and provide said air tight seal.

10. The apparatus according to claim 1 wherein said upper portions are substantially parallel, wherein said lower portions substantially reside in the same plane and wherein said intermediate portion of said ducts are disposed angularly with respect to each other at a third included angle of about 60°.

* * * * *